United States Patent [19]

Shiba

[11] Patent Number: 5,052,296

[45] Date of Patent: Oct. 1, 1991

[54] CONTROL DEVICE FOR PAPER TRAVELLING TENSION AND PAPER CUTTING POSITION IN PRINTING APPARATUS

[75] Inventor: Noriyuki Shiba, Tokyo, Japan

[73] Assignee: Kabushikigaisha Tokyo Kikai Seisakusho, Tokyo, Japan

[21] Appl. No.: 575,412

[22] Filed: Aug. 30, 1990

[30] Foreign Application Priority Data

Sep. 5, 1989 [JP] Japan ..... 1-229538

[51] Int. Cl.[5] ..... B41F 5/04

[52] U.S. Cl. ..... 101/227; 101/228; 226/45; 226/109; 226/195; 364/471

[58] Field of Search ..... 101/248, 219, 220, 221, 101/226–227, 228; 226/4, 45, 92, 108, 109, 111, 195; 364/469, 471

[56] References Cited

U.S. PATENT DOCUMENTS

| | | | |
|---|---|---|---|
| 3,591,279 | 7/1971 | Gardner | 101/227 |
| 4,007,866 | 2/1977 | Traise | 226/111 |
| 4,011,975 | 3/1977 | Brown, Jr. | 226/109 |
| 4,078,487 | 3/1978 | Mccomb | 101/228 |
| 4,750,659 | 6/1988 | Maier et al. | 101/228 |
| 4,896,605 | 1/1990 | Schroder | 226/45 |
| 4,898,094 | 2/1990 | Doumoto et al. | 226/111 |

FOREIGN PATENT DOCUMENTS

| | | |
|---|---|---|
| 60-38309 | 8/1985 | Japan . |
| 63-97566 | 4/1988 | Japan . |

*Primary Examiner*—Eugene H. Eickholt
*Attorney, Agent, or Firm*—Foley & Lardner

[57] ABSTRACT

This invention relates to a control device for adjusting the travelling tension and the cutting position of printing paper in a printing apparatus. The control device automatically controls the travelling tension of the paper webs within a reference control range, which depends on the number of the paper webs, when the printing machine is driven at a constant speed or when changing speeds slowly. This control device also automatically corrects over-stretching or loosening of the travelling paper webs due to the resistance or the inertial force of guide rollers when the printing machine is driven to change speeds quickly such as at the start or end of the printing operation.

1 Claim, 3 Drawing Sheets

CONTROL DEVICE FOR PAPER TRAVELLING TENSION AND PAPER CUTTING POSITION IN PRINTING APPARATUS

BACKGROUND OF THE INVENTION

1. Field of the Invention

The present invention relates to a control device for adjusting the travelling tension and cutting position of a printing paper web in a printing apparatus which can perform printing work, folding work and cutting work in a continuous operation. More particularly, the present invention relates to a control device which can automatically control the travelling tension of the printing paper web travelling on the upstream side of a paper to fold the printing paper longitudinally and also automatically adjust the cutting position with respect to each printed pattern whenever the printing speed is changed.

2. Description of the Prior Art

One typical conventional printing apparatus such as a rotary press printing system employing a rolled type printing paper web and capable of performing a continuous operation of printing work, folding work and paper cutting work, has been commonly used in newspaper publishing. In such a rotary press printing system, a control device for automatically controlling the tension of the printing paper travelling on the upstream side of a paper former and another control device for adjusting cutting position with respect to each printed pattern are individually arranged.

The control device for the paper travelling tension has been well known as discussed in Japanese Patent Publication No. 60-38309, titled "Paper Travelling Tension Control Device in Rotary Press" (referred as 1st prior art). The control device for the paper cutting position has been well known as discussed in Japanese Patent Application Laid Open Publication No. 63-97566, titled "Paper Cutting Position Automatic Control Device in Rotary Press" (referred as 2nd prior art).

The control device shown in the 1st prior art includes a detector which detects the travelling tension of each travelling paper at the upstream side of a drag roller and outputs the detected signal as an electric signal. Further, the control device includes a comparator which compares the detected signal with a reference signal representing a control range and outputs a compared signal resulting from the comparison. According to this compared signal, a pneumatic control means generates pneumatic pressure to automatically adjust the pressure force of propeller rollers applied onto the drag roller above the drag roller and the pressure force of a movable roller of a pair of nipping rollers below the drag roller with respect to a fixed roller of the nipping roller pair. This pneumatic pressure control operation can also adjust the contacting pressure for dragging the printing paper between the fixed roller of the nipping rollers and the drag roller, and thus the paper travelling speed is controlled. The tension of the travelling paper is also maintained in a constant state.

The device shown in the 2nd prior art discloses an adjustable roller arranged in a paper travelling system. This adjustable roller can be moved to change the length from a printing device to a folding device to correct each cutting length of the printing paper with a change in the printed pattern. Further, in this prior art, a cutting mark is also printed on each printed section and a cutting cylinder is provided with an encoder. A mark detector is arranged in front of the folding device to detect the cutting mark printed on the printed section travelling immediately before the folding device. The encoder can always detect the revolving phase of the cutting cylinder as a digital signal. This digital signal is compared with the detected signal by the mark detector to calculate a phase difference between the detected signal and preset reference signal. According to this calculation, the adjustable roller is moved in response to the phase difference. In detail, the adjustable roller is moved the distance corresponding to the absolute value of the phase difference and in the direction corresponding to the plus or minus value of the phase difference. Further, another encoder is set in a transmission between the adjustable roller and its driving motor to calculate the moved distance. The driving motor is stopped whenever the calculated value is zero.

In the 1st prior art, the paper travelling tension is controlled by changing the pressure force of the propeller roller onto the drag roller above the propeller roller and the pressure force of the movable roller of the nipping roller pair onto the fixed roller of the nipping roller pair. This control is conducted as follows. The drag roller and the fixed roller of the nipping roller pair are driven at a slightly faster speed than the travelling speed of the printing paper at the upstream side of the drag roller, for example, the feeding speed of the printing paper from the printing section. Then, the travelling tension of the printing paper at the upstream side adjacent to the drag roller is detected.

When the detected tension value is greater than a reference value, the pressure force of the propeller roller is decreased to lower the contact-friction force generated between the drag roller and the printing paper and the overlapped sections of the printing papers. Further, the travelling speed of the printing paper by the drag roller is also reduced so that he travelling tension of the printing paper between the printing section and the drag roller is decreased. On the same occasion, the pressure force of the movable nipping roller is also decreased to lower the contact-friction force generated between the fixed nipping roller and the printing paper, and the overlapped sections of the printing paper. The travelling speed of the printing paper by the fixed nipping roller is also reduced to be in balance with the travelling speed of the paper by the drag roller.

On the other hand, when the detected tension value is smaller than the reference value, the pressure forces of the propeller roller and the movable nipping roller are increased to increase the travelling speed of the printing paper by the drag roller and the fixed nipping roller. Thus, the travelling tension between the printing section and the drag roller is increased and the travelling speed of the printing paper which is controlled by the drag roller is balanced with that of the fixed nipping roller.

This control system is effective when the rotary press is driven at a constant speed or when changing at a slow speed.

However, the following problems occur when the rotary press is driven to change speeds quickly, as for example at the start or end of its operation.

At the start of its operation, after receiving a start signal, the rotary press is supplied with a speed-up signal to increase its driving speed until it reaches a preset value. On the same occasion, the revolving speed of the printing cylinder of the printing section, the drag roller, the fixed nipping roller and the other driven revolving members are also increased. Many guide rollers which are not driven and which are arranged between the printing cylinder and the drag roller for guiding the printing paper through the press are revolved by a contact-friction force created between the travelling printing paper and the guide rollers. Immediately after starting the printing operation, the printing speed is quickly increased. However, the circumferential speed of the guide rollers can not follow the travelling speed of the printing paper due to the friction resistance generated around the bearings of the guide rollers. The guide rollers thus act as a load against the travelling paper. Therefore, the travelling tension applied to the printing paper between the printing section and the drag roller is not uniform. Travelling tension near the downstream side of the printing section is smaller than the travelling tension near the upstream side of the drag roller. This reduces the pressure force of the propeller roller and the pressure force of the movable nipping roller. The contact-friction forces generated between the drag roller and the travelling paper, between the fixed nipping roller and the travelling paper, and between the lapped printing papers are also decreased. Thus, the travelling speed of the printing paper is lower than when the printing operation is conducted at a constant speed. On the contrary, a cutting and folding cylinder of the folding section is driven in synchronism with the driven revolving members to ensure that the printed section coincides with the cutting interval. However, when the printed section is delayed, regardless of the revolving speed of the driven revolving members, the cut line made by the cutting and folding cylinder doe snot coincide with the actually printed section as shown in FIG. 4.

At the end of its operation, after receiving a deceleration signal, the revolving speed of the rotary press is reduced to a preset value. On the same occasion, each revolving speed of the driven revolving members are also lowered. The guide rollers are, however, free from the driven revolving members, and thus they have a tendency to revolve at a high speed owing to their own inertia force. The circumferential speed of the guide rollers cannot follow the reduction of the travelling speed of the printing paper, and the guide rollers act as a counter-force against the reduction of the travelling speed. Therefore, the printing paper is forcibly fed by the guide rollers. Thus, the travelling tension of the printing paper near the downstream side of the printing section is greater than the travelling tension near the upstream side of the drag roller where the printing paper becomes oversupplied by the feeding motion of the guide rollers. Then, the pressure force of the propeller roller and the pressure force of the movable nipping roller are increased. The contact-friction forces created by the drag roller, the fixed nipping roller, and the lapped printing papers are also increased. The paper therefore travels at a higher speed as compared to when the printing operation is conducted at a constant speed. As a result, the printed section of the printing paper is advanced beyond the line to be cut, the normal position of the cut line being shown in FIG. 3. On the contrary, the cutting and folding cylinder is driven in synchronism with the driven revolving members to synchronize the cutting timing with the paper travelling speed. Therefore, when the printed section is advanced, the line which is cut by the cutting and folding cylinder does not coincide with the actually printed section as is shown in FIG. 5.

In order to resolve this problem, the cutting position control device shown in the 2nd prior art has been provided with a capability to coincide the printed section with the cutting line. However, this control device requires a mark detecting means for detecting a cutting mark to correctly indicate the printed section location and a phase detecting means for detecting the revolving phase of the cutting and folding cylinder. These means increase the production cost of the printed matters and the printing apparatus per se. Further, this device will start its correcting operation after deviation between the printed section and the cutting position is generated. Thus, this device cannot prevent the generation of such deviation, and requires a relative long time to return the printing apparatus to its regular operational mode after the deviation is detected. Accordingly, this device cannot overcome a loss in production due to the deviation between the printed section and the cut position.

SUMMARY OF THE INVENTION

It is an object of the present invention to provide a control device for controlling printing paper travelling tension and for controlling the cutting position of printing paper in order to execute printing work, folding work and cutting work with a high efficiency.

Another object of the present invention is to provide a control device for controlling the travelling tension and the cutting position of printing paper to correctly cut the printed section without any deviation even when the paper travelling speed is changed slowly or quickly.

To accomplish the above objects, the control device according to the present invention is characterized as follows. In a printing apparatus having a plurality of paper suppliers, and plurality of printing machines, a plurality of paper guiding means, and a paper former, there is a control for controlling paper travelling tension and paper cutting position. The control includes a drag roller arranged at the upstream side of the paper former; and plurality of propeller rollers whose pressure force against the drag roller can be controlled. In addition, the control has at least one pair of nipping rollers arranged at the downstream side of the paper former with the pressure force of the movable roller of the pair of nipping rollers being controllable. The control also has a paper tension detecting device for detecting paper tension and for outputting the detected tension as a tension signal which is arranged at the upstream side of the drag roller. An acceleration detecting device for detecting the acceleration of the revolving speed of the printing machine and for outputting the detected acceleration as an acceleration signal is also provided as part of the control. In addition, a control signal outputting device is included as part of the control. The control signal outputting device receives the tension signal and the acceleration signal, and outputs a tension control signal when the acceleration signal is in a predetermined range, and a tension and acceleration control signal when the acceleration signal is out of the predetermined range so that the pressure force of the propeller rollers against the drag roller, and the pressure force of the movable nipping roller against the fixed nipping roller of the same pair are controlled.

Other features and advantages of the present invention will be apparent from the following description taken in connection with the accompanying drawings.

BRIEF DESCRIPTION OF THE DRAWINGS

FIG. 4 showing an irregular cutting state, the cutting line is being delayed to the printed pattern; and FIG. 5 shows another irregular cutting state, the cutting line being advanced to the printed pattern.

DETAILED DESCRIPTION OF THE PREFERRED EMBODIMENTS

One preferred embodiment will be described in detail with reference to FIG. 1 and FIG. 2.

Figure 2:
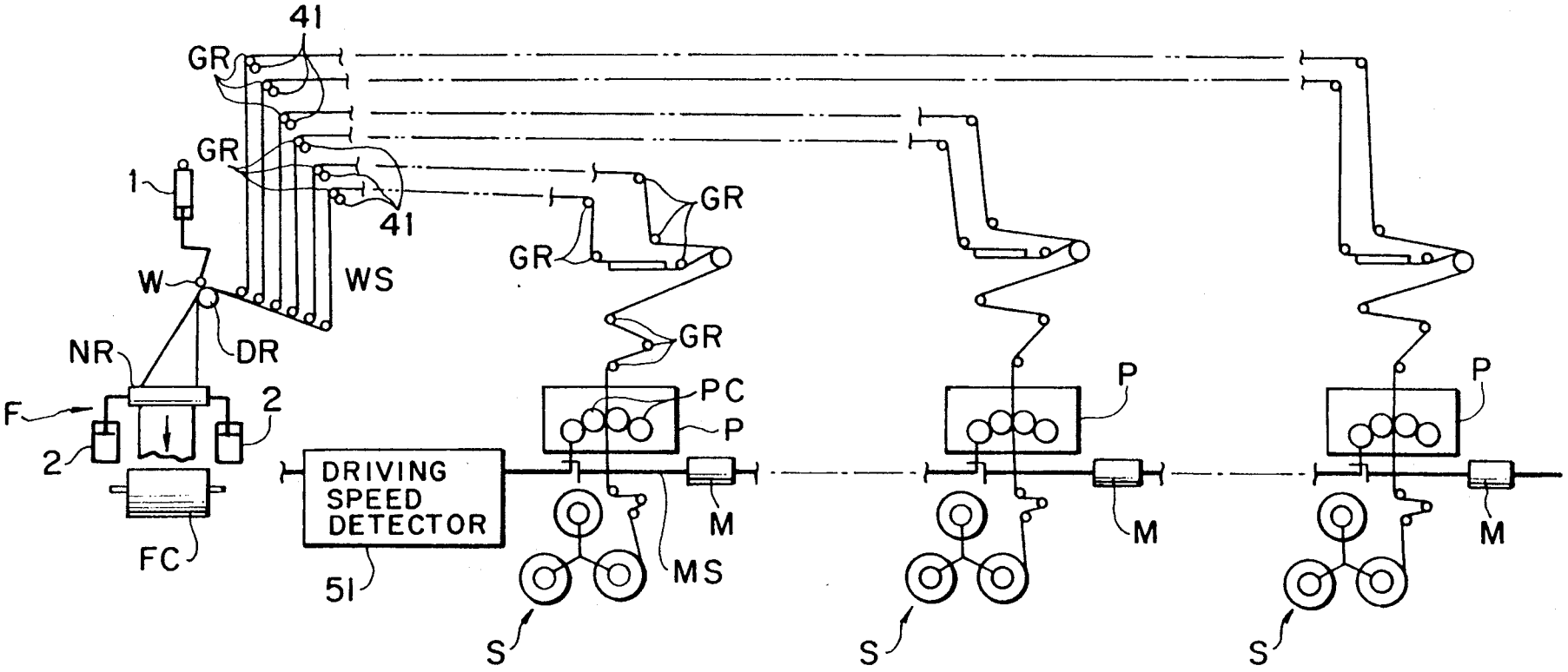
FIG. 2 is a schematic illustration showing an overall view of the printing apparatus combined with the control device according to the present invention.
Figure 5:
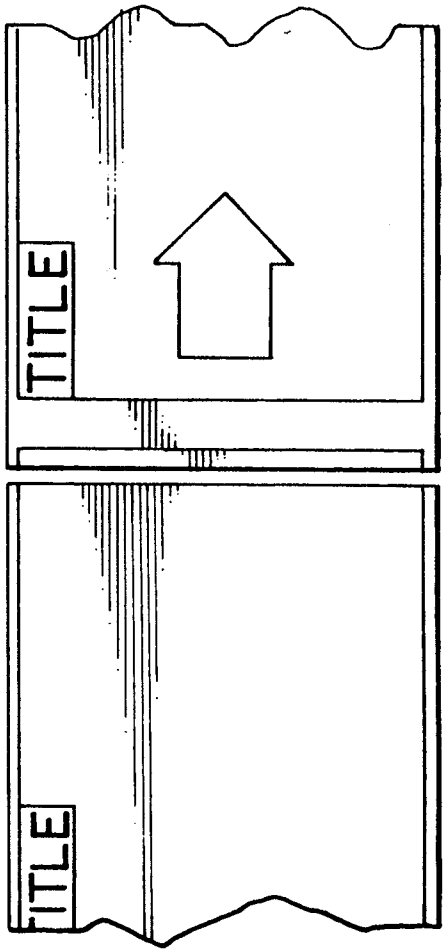
FIG. 3 to FIG. 5 are schematic illustrations for explaining the relation between the printed pattern and the cutted line FIG. 3 showing a normal cutting state.
Figure 4:
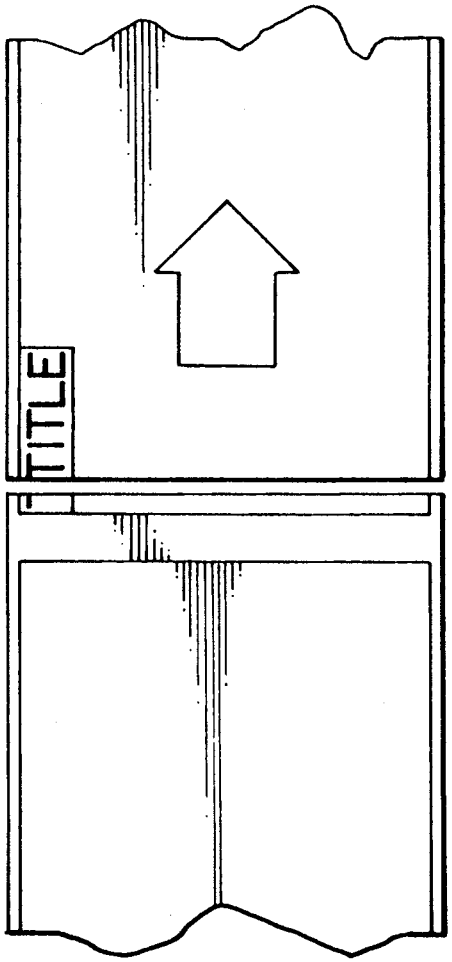
Figure 3:
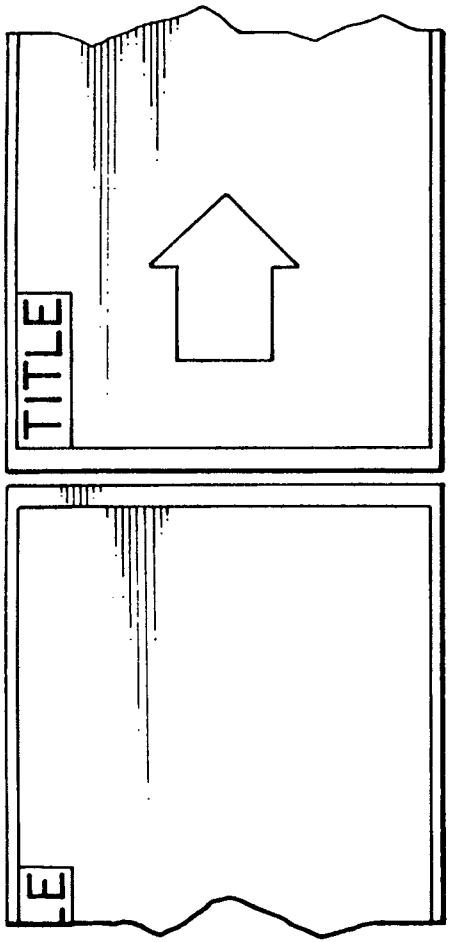

As shown in FIG. 2, a printing apparatus comprises a plurality of paper suppliers S, a plurality of printing machines P, a paper forming unit F, and a plurality of guiding means including many guide rollers GR (which are also represented by dotted lines). A printing cylinder PC in each printing machine P and a cutting and folding cylinder FC of the paper forming unit F are driven by driving members M mechanically connected to a main drive shaft MS. A drag roller DR, and a fixed roller NR1 of nipping roller pair NR are respectively connected to the main drive shaft MS through a driving force transmitting system, not shown. The circumferential speeds of the drag roller DR and the fixed roller NR1 are driven at a slightly faster speed than that of the printing cylinder PC.

Figure 1:
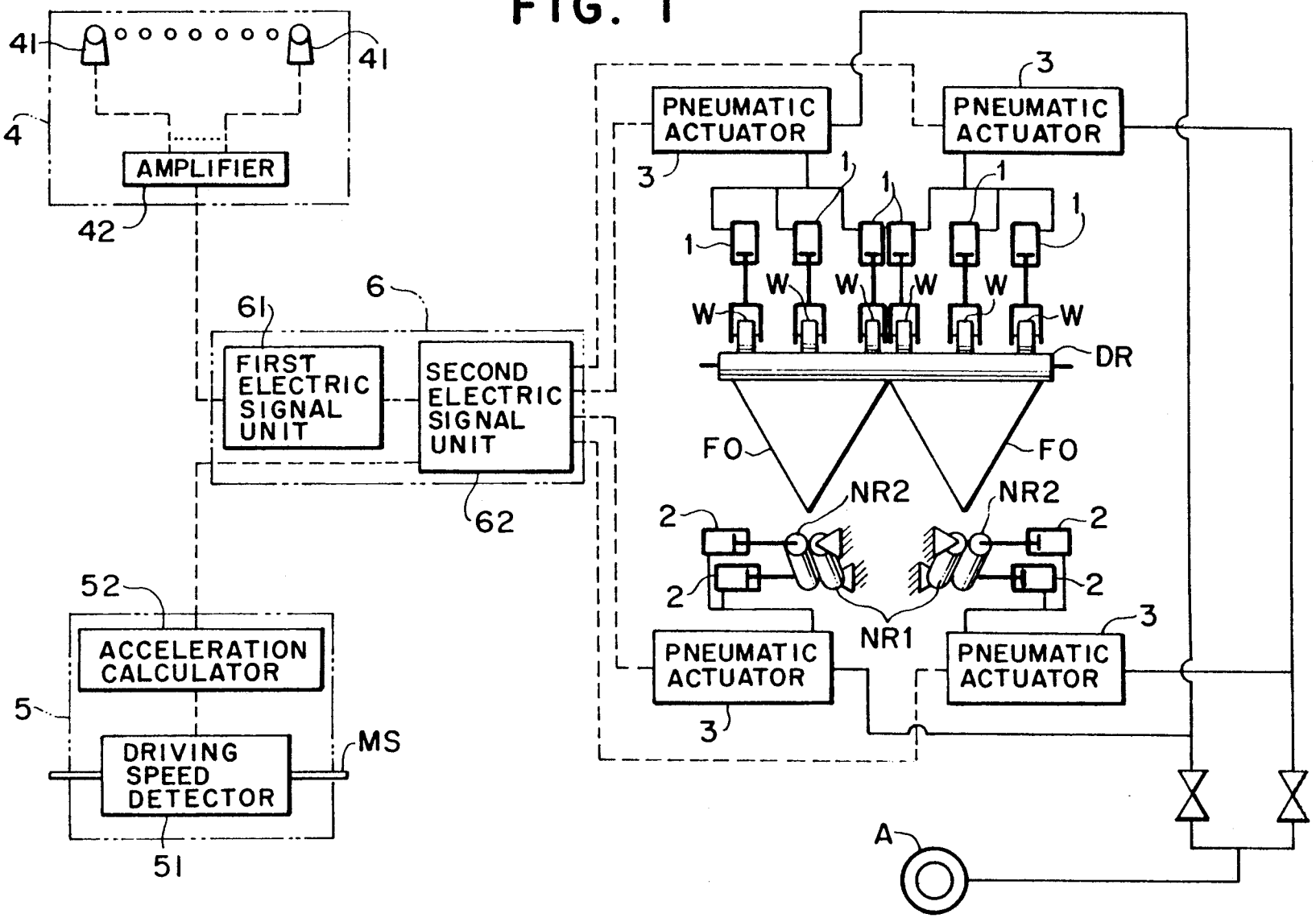
FIG. 1 is a schematic diagram showing one preferred embodiment of the control device according to the present invention.

As shown in FIG. 1, a plurality of propeller rollers W are arranged on the circumferential surface of the drag roller DR, and biased to be brought in contact with the circumferential surface of the drag roller DR by first pneumatic cylinders 1. A movable roller NR2 of each nipping roller of each nipping roller pair NR is supported by two second pneumatic cylinders 2 through both of its end axis and is biased to be brought in contact with the circumferential surface of the fixed roller NR1. These first and second pneumatic cylinders 1 and 2 are in communication with a pneumatic power source A through electro-pneumatic actuators 3 which are electrically controlled by electric signals.

Numeral 4 denotes a paper tension detecting means including a plurality of paper tension detectors 41, 41, 41 . . . for detecting the paper tension of a printing paper web WS and an amplifier 42 for amplifying the detected signal generated by the detectors 41. The paper tension detectors 41 are arranged at the upstream side of the drag roller DR.

Numeral 5 denotes an acceleration detecting means which includes a driving speed detector 51 and an acceleration calculator 52 which is supplied with an electric signal from the driving speed detector 51 to calculate actual acceleration. The driving speed detector 51 is mechanically connected to the main drive shaft MS.

Numeral 6 denotes a control signal outputting means which is electrically connected to the paper tension detecting means 4 and the acceleration detecting means 5. The output signal from the paper tension detecting means 4 is supplied into a first electric signal output unit 61 and the output signal from the acceleration detecting means 5 and the output signal from the first electric signal output unit 61 are supplied to a second electric signal output unit 62. Then, the second electric signal output unit 62 outputs a control signal to the electric pneumatic actuator 3.

In the above embodiment, as shown in FIG. 2, the paper tension detectors 41 are combined within the guide rollers GR. However, many other arrangements may be applied in this invention, as for example, non-contacting type paper tension detectors may be arranged along the paper travelling system. Also, the driving speed may be detected at any proper position, and is not limited to the main driving shaft MS.

One typical operation of the above described embodiment is described below.

As the printing cylinders PC of each printing machine P revolve, the printing paper webs WS travel around the many guide rollers GR which are arranged in each travelling system. After passing through the paper tension detectors 41, the paper webs WS are lapped and travel to the narrow space between the drag roller DR and the propeller rollers W. Then, the lapped paper webs WS are forcibly brought into contact with the circumferential surface of the drag roller DR by the propeller rollers W which are biased by the first pneumatic cylinders 1. Thus, for the papers which travel from the printing machines P to the drag roller DR, the travelling tension is applied to the lapped paper webs WS by the contact friction between the circumferential surface of the drag roller DR and the paper surface, and between the lapped paper webs when the circumferential speed of the drag roller DR is revolved at a slightly faster speed than that of the printing cylinder PC. Further, the lapped paper webs WS are fed into a former FO arranged at the downstream side of the drag roller DR where they are folded along the longitudinal direction of the paper web.

If the paper web travels through the former FO in a loose or over-stretched condition, the former FO cannot completely fold the paper longitudinally. To avoid this problem, the lapped paper webs WS are introduced into the narrow space between the fixed nipping roller NR1 and the movable nipping roller NR2 which are arranged on the downstream side of the former FO. The lapped paper webs WS are pressed toward the fixed nipping roller NR1 by the movable nipping roller NRs which is biased by the second pneumatic cylinders 2. Thus, the lapped paper webs WS are forcibly moved by the revolving motion of the fixed nipping roller NR1 in combination with the contact friction forces between the circumferential surface of the fixed roller NR1 and the paper web WS and between the lapped paper webs WS.

After passing through the nipping roller pair NR, the lapped paper webs WS are cut and folded by the cutting and folding cylinder FC.

The contact friction forces between the circumferential surface of the fixed roller NR1 and the paper web WS, between the circumferential surface of the drag roller DR and the paper web WS, and between the lapped paper webs WS are generated by the revolving force of the drag roller DR and the fixed nipping roller NR1, the pressure force of the propeller rollers W against the drag roller DR, and the pressure force of the movable nipping roller NR2 against the fixed nipping roller NR1. The magnitude of the contact friction forces depends on the pressure force of the propeller rollers W and/or the pressure force of the movable nipping roller NR2. As mentioned above, the circumferential speed of the drag roller DR and the fixed nipping roller NR1 is slightly faster than that of the printing cylinder PC.

On the other hand, the tension detectors 41 of the paper tension detecting means 4 detect the travelling tension applied to the printing paper web WS and convert the detected values into electric signals. The electric signals are further amplified by the amplifier 42 and are outputted to the control signal outputting means 6. In the acceleration detecting means 5, the driving speed detector 51 detects the driving speed of the main driving shaft MS and outputs the detected signal to the acceleration calculator 52. The calculator 52 calculates the acceleration of the driving speed of the printing machine and outputs the calculated value as an electric signal to the control signal outputting means 6.

The control signal outputting means 6 is supplied with required information such as the number of travelling paper webs which has been previously inputted as a preset value or which can be automatically detected by any conventional travelling paper detectors, not shown, which are arranged at each paper travelling line. Further, the electric signals from the paper tension detecting means 4 and the acceleration detecting means 5 are inputted to the control signal outputting means 6. Then, the first electric signal output unit 61 of the control signal outputting means 6 determined a reference control range for the paper travelling tension according to the number of travelling paper webs, and compares the electric signals from the paper tension detecting means 4 with the reference control range determined for each travelling paper web WS. When the electric signals from the paper tension detecting means 4 are all within the reference control range, the first electric signal output unit 61 outputs an electric signal which is predetermined in response to the reference control range. When any one of the electric signals is out of the reference control range, the unit 61 outputs a corrected signal which is corrected in response to the difference between the electric signal and the reference control range.

A reason why the reference control range depends on the number of travelling paper webs is as follows.

As mentioned above, the contact friction forces between the circumferential surface of the fixed roller NR1 and the paper web WS, between the circumferential surface of the drag roller DR and the paper web WS, and between the lapped paper webs WS are generated by the revolving force of the drag roller DR and the fixed nipping roller NR1, the pressure force of the propeller rollers W against the drag roller DR, and the pressure force of the movable nipping roller NR2 against the fixed nipping roller NR1. The printing paper webs are travelled by these contact friction forces and the revolving forces. Therefore, the travelling tensions applied on respective paper webs are not uniform. In detail, the paper web travelling adjacent to the propeller rollers W or the movable nipping roller NR2 is less applied with the contact friction force. To correct this function, the reference control range should be varied in response to the number of lapped papers.

On the other hand, the tension applied on each paper web should be compared with the reference control range to confirm that every tension is within the range. Although the average tension may be within the range, each individual paper web tension may not always be within the range.

The electric signal output from the first electric signal output unit 61 is fed, with the electric signal from the acceleration detecting means 5, to the second electric signal output unit 62. The unit 62 compares the electric signal from the acceleration detecting means 5 with a preset reference acceleration range. When the electric signal is within the range, the unit 62 outputs the electric signal from the first electric signal output unit 61 directly to the electric-pneumatic actuators 3. When the electric signal from the acceleration detecting means 5 is out of the range, the unit 62 outputs a corrected signal which is corrected in response to the difference between the electric signal from the first electric signal output unit 61 and the reference acceleration range.

In response to the electric signal from the second electric signal output unit 62 of the control signal outputting means 6, the electric-pneumatic actuators 3 change the pneumatic force fed to the first pneumatic cylinders 1 and the second pneumatic cylinders 2. Then, the pressure force of the propeller rollers W against the drag roller DR is changed by the first pneumatic cylinders 1. The pressure force of the movable nipping rollers NR2 against the fixed nipping rollers NR1 is changed by the second pneumatic cylinders 2. Accordingly, the contact friction forces between the circumferential surface of the fixed roller NR1 and the paper web WS, between the circumferential surface of the drag roller DR and the paper web WS, and between the lapped paper webs WS are also changed. The friction between the paper web WS and the circumferential surface of the fixed nipping roller NR1 or the drag roller DR is remarkably changed. As a result, the stretching force and travelling speed of the paper webs WS are varied.

As discussed above, when the printing machine is driven at a constant speed or when changing at a slow speed, the travelling tension applied to the paper webs WS is automatically controlled within the reference control range in response to the number of the paper webs WS. Conversely, when the printing machine is driven to change speed quickly, as at the start or end of the printing operation, the travelling tension applied to the paper webs WS is automatically controlled to correct the situation where travelling paper webs WS are overstretched or too loose due to the resistance of or the inertial force of the guide rollers GR.

It is further understood by those skilled in the art that the foregoing description is a preferred embodiment of the disclosed device and that various changes and modifications may be made to the invention without departing from the spirit and scope thereof.

What is claimed is:

1. In a printing apparatus comprising a plurality of paper suppliers, a plurality of printing machines, a plurality of paper guiding means, and a paper forming means;

a control device for controlling paper travelling tension and paper cutting position comprising a drag roller arranged at an upstream side of the paper forming means;

a plurality of propeller rollers which exert a controllable pressure force against the drag roller;

at least one pair of nipping rollers including a fixed nipping roller and a movable roller which are arranged at a downstream side of the paper forming means, wherein a pressure force of a movable nipping roller is controllable;

a paper tension detecting means, arranged at an upstream side of the roller, for detecting the paper tension and outputting the detected tension as a tension signal;

an acceleration detecting means for detecting the acceleration of the revolving speed of the printing machines and for outputting the detected acceleration as an acceleration signal; and a control signal outputting means for receiving the tension signal and the acceleration signal, and for outputting a tension control signal when the acceleration signal is within a predetermined range and for outputting a tension and acceleration control signal when the acceleration signal is not within the predetermined range so that the pressure force of the propeller roller against the drag roller and the pressure force of the movable nipping roller against the fixed nipping roller of the same pair are controlled.

* * * * *